US009453277B2

(12) United States Patent
Watanabe et al.

(10) Patent No.: US 9,453,277 B2
(45) Date of Patent: Sep. 27, 2016

(54) METHOD OF HEAT TREATMENT AND THE DIRECTIONS FOR USE OF FURNACE OF HEAT TREATMENT

(71) Applicants: Takanori Watanabe, Kobe (JP); Asahiro Sakata, Wakayama (JP); Hideaki Iwamura, Amagasaki (JP)

(72) Inventors: Takanori Watanabe, Kobe (JP); Asahiro Sakata, Wakayama (JP); Hideaki Iwamura, Amagasaki (JP)

(73) Assignee: Air Water Inc. (JP)

( * ) Notice: Subject to any disclaimer, the term of this patent is extended or adjusted under 35 U.S.C. 154(b) by 269 days.

(21) Appl. No.: 14/133,935

(22) Filed: Dec. 19, 2013

(65) Prior Publication Data

US 2014/0102593 A1 Apr. 17, 2014

Related U.S. Application Data

(62) Division of application No. 13/063,006, filed as application No. PCT/JP2009/066209 on Sep. 10, 2009, now abandoned.

(30) Foreign Application Priority Data

Sep. 17, 2008 (JP) ..... 2008-238174

(51) Int. Cl.

| | |
|---|---|
| ***C23C 8/26*** | (2006.01) |
| ***C22C 19/03*** | (2006.01) |
| ***C23C 8/24*** | (2006.01) |
| ***C21D 1/06*** | (2006.01) |
| ***C21D 1/76*** | (2006.01) |
| ***C22C 19/05*** | (2006.01) |
| ***C23C 8/02*** | (2006.01) |
| ***C23C 8/34*** | (2006.01) |
| ***C23C 8/80*** | (2006.01) |
| ***F27B 5/04*** | (2006.01) |
| ***F27D 7/02*** | (2006.01) |
| ***F27D 7/06*** | (2006.01) |

(52) U.S. Cl.

CPC . *C23C 8/24* (2013.01); *C21D 1/06* (2013.01); *C21D 1/76* (2013.01); *C22C 19/055* (2013.01); *C22C 19/056* (2013.01); *C23C 8/02* (2013.01); *C23C 8/34* (2013.01); *C23C 8/80* (2013.01); *F27B 5/04* (2013.01); *F27D 7/02* (2013.01); *F27D 7/06* (2013.01)

(58) Field of Classification Search

CPC ..... C23C 8/24; C23C 8/48; C23C 8/26; C23C 8/32

USPC ..... 148/208, 212

See application file for complete search history.

(56) References Cited

U.S. PATENT DOCUMENTS 4,145,232 A * 3/1979 Solomon ..... 148/218
5,445,683 A * 8/1995 Tahara et al. ..... 148/317

FOREIGN PATENT DOCUMENTS

EP 0 588 458 * 3/1994 ..... C23C 8/26

*Primary Examiner* — Jessee Roe

(74) *Attorney, Agent, or Firm* — Wood, Phillips, Katz, Clark & Mortimer

(57) ABSTRACT

A furnace of heat treatment capable of keeping a stable nitriding quality for a long period of time is provided. The furnace of heat treatment performs a halogenation treatment and a nitriding treatment by heating a steel material under a predetermined atmosphere. An alloy containing Ni ranging between 50 mass % or more and 80 mass % or less and Fe ranging between 0 mass % or more and 20 mass % or less is used as a material of surfaces of core internals exposed to a treatment space where the nitriding treatment is performed. Accordingly, a nitriding reaction is hardly caused on the surfaces of the core internals, and the halogenation treatment and the nitriding treatment to an article to be treated can be stably executed for a long period of time. Further, a nitrided layer can be stably formed according to purposes on any types of steel materials including a steel type hard to be nitride.

13 Claims, 6 Drawing Sheets

EXAMPLE (d) (NCF600 : W/ GRINDING AFTER 1000 TIMES NITRIDING TREATMENT)

COMPARATIVE EXAMPLE (e) (NCF600: W/O GRINDING)

METHOD OF HEAT TREATMENT AND THE DIRECTIONS FOR USE OF FURNACE OF HEAT TREATMENT

CROSS-REFERENCE TO RELATED APPLICATIONS

This application is a divisional of U.S. patent application Ser. No. 13/063,006, filed on Mar. 9, 2011, now abandoned.

TECHNICAL FIELD

The present invention relates to a furnace of heat treatment for implementing a nitriding treatment associated with a halogenation treatment to a steel material, a method of the heat treatment and directions for use of furnace of the heat treatment.

RELATED ART

In order to improve an abrasion resistance and a durability of various kinds of steel materials, as a method for improving a surface hardness and a surface compression stress by introducing N and C into the surface portion, various kinds of nitriding treatments, e.g., a gas nitriding treatment, a salt bath nitriding treatment, and an ion and plasma nitriding treatment, have been implemented. Among those treatments, such a gas nitriding treatment (including a gas nitrocarburizing treatment), excellent in productivity, is disclosed and implemented that a surface oxide film which inhibits nitriding of the surface of an article to be treated is removed by using halogen and halide to form a nitrided layer according to the treatment and the purpose of the nitriding process for a material which is hard to be nitrided (see, for example, Patent Documents 1, 2, 3, and 4).

According to the above treatments, for example, even if the article to be treated has a robust surface oxide film, e.g., a stainless steel, the nitrided layer having an even thickness can be formed.

On the other hand, implementation of the above treatments forces core internals, including jigs and furnace walls placed within a furnace, into a state they are easily nitrided. In other words, $NH_3$ gas to be used in the nitriding treatment is broken down by a catalytic action caused on the surfaces of the article to be treated, the jigs, the furnace walls, and the like. Nitrogen (N) generated at the time enters into the article to be treated from the surface of the article to be treated, thereby progressing the nitriding reaction. At the time, a temperature of the surfaces of the furnace walls and the core internals near a heat source for raising a temperature within the furnace becomes higher than a temperature of the gas within the furnace. Therefore, the surfaces of the furnace walls and the core internals near the heat source come to be easily nitrided.

Accordingly, in a case where the nitriding treatment is performed by using halogen and halide, the core internals are desirably made of a material having a corrosion resistance in addition to a heat resistance. For example, a method for using a nickel-base heat resistance alloy is disclosed in the embodiment of Patent Document 5.

Patent Document 1: JP 2,881,111
Patent Document 2: JP 06-299317(A)
Patent Document 3: JP 09-013162(A)
Patent Document 4: JP 3,643,882
Patent Document 5: JP 3,428,847

SUMMARY OF THE INVENTION

Problems to be Solved by the Invention

However, it was discovered that, even in a case where the above described material having the corrosion resistance and the heat resistance is used, if the nitriding treatment is repeated, such a case occurs that quality of the article to be treated, e.g., a hardness and a thickness of the nitrided layer, cannot be kept.

As a result of a detailed search, it was discovered that a factor that the quality of the article to be treated cannot be kept is caused by the nitriding reaction gradually progressed not only in the jig for placing the article to be treated within the furnace but also in the surfaces of the furnace walls away from the article to be treated. In other words, a rough surface is caused according to the nitriding reaction progressed on, for example, the surfaces of the furnace walls and, further, an embrittlement of the surfaces occurs as the nitriding progresses on the surfaces. Many cracks may be generated around a crystal grain boundary if the temperature is repeatedly fluctuated.

Accordingly, the surfaces come to be a state that the surfaces easily adsorb the gas in, for example, moisture. Further, deterioration of the catalytic action may affect the hardness and the thickness of the nitrided layer of the article to be treated.

As described above, in the furnace of heat treatment configured to perform the nitriding treatment by using halogen and halide, a method for controlling the state of the surfaces of, for example, the furnace walls, to keep the nitriding quality stable for a long period of time is not presently disclosed. Specifically, since the material of the furnace walls cannot be easily replaced, an extension of the life of the furnace walls has been an important issue for a long period of time because it directly affects on the extension of the life of the furnace of heat treatment itself.

The present invention is made for the purpose of resolving the above described problems, and is directed to a furnace of heat treatment capable of keeping a stable nitriding quality for a long period of time, a method of heat treatment, and a method for using the furnace of heat treatment.

Means for Solving the Problem

In order to achieve the above objectives, according to one aspect of the invention, a furnace of heat treatment is provided, which performs a halogenation treatment and a nitriding treatment by heating a steel material under a predetermined atmosphere. An alloy containing Ni ranging between 50 mass % or more and 80 mass % or less and Fe ranging between 0 mass % or more and 20 mass % or less is used as a material of a surface of a core internal exposed to a treatment space where the nitriding treatment is performed.

In order to achieve the above objectives, according to another aspect of the invention, a method of heat treatment is provided, which performs a halogenation treatment and a nitriding treatment by heating a steel material under a predetermined atmosphere. The method includes using an alloy containing Ni ranging between 50 mass % or more and 80 mass % or less and Fe ranging between 0 mass % or more and 20 mass % or less as a material of a surface of a core internal exposed to a treatment space where the nitriding treatment is performed.

In order to achieve the above objectives, according to another aspect of the invention, a directions for use of a furnace of heat treatment is provided, which performs a halogenation treatment and a nitriding treatment by heating a steel material under a predetermined atmosphere. The method includes using an alloy containing Ni ranging between 50 mass % or more and 80 mass % or less and Fe ranging between 0 mass % or more and 20 mass % or less as a material of a surface of a core internal exposed to a treatment space where the nitriding treatment is performed, and using, when the halogenation treatment and the nitriding treatment are repeated, a nitrided layer formed on the surface of the core internal is used within a range of a thickness equal to or less than 25 μm and a surface hardness equal to or less than 900 Hv.

Effect of the Invention

In the furnace of heat treatment and the method of heat treatment according to the aspects of the invention, the alloy containing Ni ranging between 50 mass % or more and 80 mass % or less and Fe ranging between 0 mass % or more and 20 mass % or less is used as the material of the surface of the core internal exposed to the treatment space where the nitriding treatment is performed. Accordingly, the surface of the core internal hardly causes a nitriding reaction and therefore the halogenation treatment and the nitriding treatment to an article to be treated can be stably executed for a long period of time. As a result, a nitrided layer can be stably formed according to purposes on any types of steel materials including a steel type hard to be nitrided.

In the furnace of heat treatment and the method of heat treatment according to the aspects of the invention, a surface roughness of the surface of the core internal may be 1.6 μm or less in Ra. The nitriding reaction may come to be hardly caused if the surface roughness of the surface of the core internal is reduced. Accordingly, the halogenation treatment and the nitriding treatment to the article to be treated may be executed stably for a long period of time.

In the furnace of heat treatment and the method of heat treatment according to the aspects of the invention, a test piece made of the same material as a material of the surface of the core internal may be placed within the treatment space. The thickness or the like of the nitrided layer formed on the core internal may be known accurately based on the test piece and thus a problem may be addressed before the problem as to a performance of the article to be treated, e.g., a poor nitriding, is caused. Further, the halogenation treatment and the nitriding treatment may be stably executed for a long period of time.

In the directions for use of the furnace of heat treatment according to the aspect of the invention, the alloy containing Ni ranging between 50 mass % or more and 80 mass % or less and Fe ranging between 0 mass % or more and 20 mass % or less is used as the material of the surface of the core internal exposed to the treatment space where the nitriding treatment is performed, and when the halogenation treatment and the nitriding treatment are repeated, the nitrided layer formed on the surface of the core internal within ranges of a thickness equal to or less than 25 μm and a surface hardness equal to or less than 900 Hv is used. Therefore, the furnace of heat treatment can be prevented from suffering a quality problem caused by a grain boundary crack or the like generated in the surfaces and, even if the nitrided layer is formed on the surface, can perform the stable halogenation treatment and nitriding treatment. Accordingly, the halogenation treatment and the nitriding treatment can be stably executed to the article to be treated for a long period of time.

In the directions for use of the furnace of heat treatment according to the aspect of the invention, at least a portion of the nitrided layer may be removed so that the surface roughness of the surface becomes 1.6 μm or less in Ra. The nitriding reaction may be hardly caused if the surface roughness of the surface of the core internal is set smaller. Accordingly, the halogenation treatment and the nitriding treatment may be stably executed to the article to be treated for a long period of time.

In the directions for use of the furnace of heat treatment according to the aspect of the invention, in a case where the nitrided layer has a thickness beyond 25 μm, at least a portion of the nitrided layer may be removed so that the nitrided layer has the thickness equal to or less than 25 μm and cracks generated in the surface are substantially eliminated. The surface which comes to be susceptible to adsorption of a gas such as moisture and thus of which catalytic action is degraded may be recovered and an effect to the halogenation treatment and the nitriding treatment to the article to be treated may be eliminated. Accordingly, the stable halogenation treatment and nitriding treatment may be recovered.

In the directions for use of the furnace of heat treatment according to the aspect of the invention, the test piece made of the same material as and having the similar surface roughness to the material of the surface of the core internal may be placed within the treatment space, and when the halogenation treatment and the nitriding treatment are repeated, the thickness of the nitrided layer formed on the surface of the core internal may be estimated base on the state of the test piece. The thickness or the like of the nitrided layer formed on the core internal may be accurately known based on the test piece. Accordingly, the performance problem of the article to be treated such as the poor nitriding may be addressed before the performance problem is caused. Further, the halogenation treatment and the nitriding treatment may be executed stably for a long period of time.

BEST MODE FOR CARRYING OUT THE INVENTION

Figure 1:
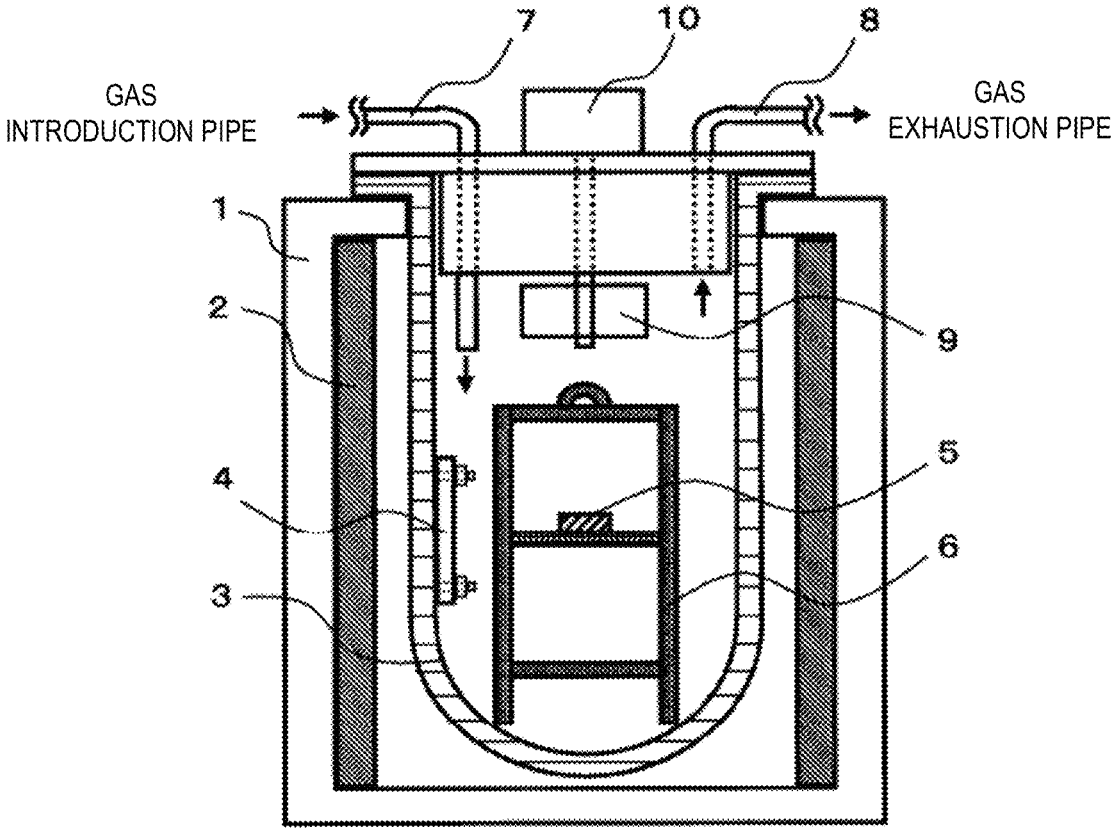
FIG. 1 is a schematic view illustrating a cross-sectional structure of an example of a treat furnace according to the present invention.

Now, the best mode for implementing the present invention is described below.

A steel material to be subjected to halogenation treatment and nitriding treatment performed by a furnace of heat treatment according to the present invention can be applied to various steel materials, e.g., a carbon steel, a low alloy steel, a high alloy steel, a structural rolled steel, a high tension steel, a steel for machine structural use, a carbon tool steel, an alloy tool steel, a high speed tool steel, a bearing steel, a spring steel, a case hardening steel, a nitriding steel, a stainless steel, and a heat resisting steel. An even nitrided layer can be stably formed on any type of the above described steels for a long period of time.

These steel materials are initially subjected to the halogenation treatment to remove a surface oxide film on the surface of the article to be treated as well as to form halide thereon. Further, these steel materials are subjected to the nitriding treatment to break down the halide, thereby diffusing and impregnating the nitrogen onto the surface of the article to be treated in order to form a nitrided layer.

Examples of the halogenation treatment include a fluorination treatment, a chlorination, a bromination treatment, and an iodine treatment.

Among them, the fluorination treatment, which is industrially easy to be used and where a processing gas can be easily treated, can be suitably used.

In the fluorination treatment, the steel material is kept heated at a temperature ranging between 200 and 600° C. for a predetermined period of time under an atmosphere containing fluorine and/or a fluorine compound such as $NF_3$ gas to remove the surface oxide film on the surface of the steel material, thereby substituting the film to fluoride as halide.

Then, the steel material after being subjected to the halogenation treatment is further subjected to the nitriding treatment in which the steel material is heated at a temperature ranging between 350 and 650° C. to be held under an atmosphere containing $NH_3$ gas for a predetermined period of time to break down the fluoride on the surface of the steel material, thereby diffusing and impregnating nitrogen atoms onto the active surface. Accordingly, a nitrided layer is formed on the surface of the steel material.

For the halogenation treatment and the nitriding treatment, the nitriding treatment may be performed after the halogenation treatment within the same treatment chamber. Alternatively, the halogenation treatment and the nitriding treatment may be performed within different treatment chambers. In a case where the nitriding treatment is performed within a different treatment chamber after the halogenation treatment, a halogenation treatment chamber and a nitriding treatment chamber may be provided within a shared furnace body, e.g., a continuous furnace. Alternatively, the halogenation treatment chamber and the nitriding treatment chamber may be included independently in separate furnace bodies.

When the nitriding treatment is performed after the halogenation treatment, the halide such as the fluoride on the surface of the steel material is reduced by H generated when the $NH_3$ is broken down and hydrogen halide such as a halogen fluoride gas is generated. These gases are eventually exhausted from the furnace and detoxified using a detoxification apparatus. However, for example, in a case where the halogenation treatment and the nitriding treatment are executed within the same treatment chamber, the surfaces of the core internals such as the surfaces of the furnace walls exposed to the treatment space where the nitriding treatment is performed are also halogenated when the halogenation treatment is performed. Therefore, when the nitriding treatment is performed after the halogenation treatment, the surfaces of the core internals are also repetitively exposed to a high concentration halogen compound gas generated by the break-down of the halide and thus the surfaces are more susceptible to the nitriding.

On the other hand, in cases of an apparatus including the halogenation treatment chamber and the nitriding treatment chamber separately and an apparatus including halogenation treatment chamber and the nitriding treatment chamber in the respective furnace bodies, a halogen compound formed on the surface of the article to be treated, a jig, or the like is brought into the nitriding treatment chamber and the surfaces of the core internals such as the furnace walls are repetitively exposed to the halogen compound gas generated by reduction of the halogen compound at the time of the nitriding treatment, so that the progress of the nitriding reaction cannot be suppressed at all.

Therefore, in this embodiment, an anti-corrosion heat resistance alloy which is an alloy containing Ni ranging between 50 mass % or more and 80 mass % or less, preferably, ranging between 60 mass % or more and 80 mass % or less, and Fe ranging between 0 mass % or more and 20 mass % or less, preferably, ranging between 0 mass % or more and 10 mass % or less, is used as the material of the surfaces of the core internals exposed to the treatment space where the nitriding treatment is performed, thereby decreasing a degradation thereof.

The core internals, e.g., the furnace walls, exposed to the treatment space plays a roll of a part or a large part of the catalytic action for breaking down $NH_3$ upon the nitriding treatment, so that the use of the above alloy prevents the catalytic action for performing the stable nitriding treatment from being degraded.

Here, Ni of the surface oxide film, specifically, formed at a high temperature is hardly destroyed against halogen and/or a halogen compound gas. If Ni is destroyed, the surface oxide film is reoxidized by a minute amount of oxygen and moisture contained in the nitriding treatment gas upon the nitriding treatment, so that the progress of the nitriding reaction being suppressed. Therefore, the more amount of contents thereof enables better reoxidation, i.e., a preferable amount of contents is a range between 50 mass % or more and 60 mass % or less.

However, if the amount of the contents becomes more than 80 mass %, the mechanical characteristics such as strength is degraded and thus such core internals are hardly used as a structural material. Also, as far as the surface film of the core internals comes to be made of pure nickel, the grain boundary cracks are susceptible to be generated when a C source is added in the furnace. Therefore, an upper limit thereof is to be 80 mass %.

It is easy to form a nitride by Fe since the Fe can be mixed with nitrogen in a solid state. Fe functions as a diffusion path of nitrogen toward a deep portion of the steel material and helps a growth of the nitrided layer in thickness upon the nitriding treatment after the halogenation treatment. To achieve the above function, a less amount of Fe is more advantageous, so that the amount of Fe is within a range between 0 mass % or more and 20 mass % or less, and preferably within a range between 0 mass % or more and 10 mass % or less.

Examples of an anti-corrosion heat resistant alloy applicable to the present invention include NCF600, NCF601, NCF625, NCF690, NCF718, NCF750, NCF751, NCF80A, a nickel-copper alloy, a nickel-copper-aluminum-titanium alloy, a nickel-molybdenum alloy, and a nickel-molybdenum-chrome alloy. The examples of the anti-corrosion heat resistant alloy applicable to the present invention also include other various developed alloys such as Inconel® (600, 601, 604, 606, 613, 617, 622, 625, 672, 686, 690, 691, 693, 702, 718, 721, 722, 725, 751, C-276, MA754, MA758, MA6000, X-750) alloy, Nimonic® alloy, and Monel™ alloy.

Among the examples of the anti-corrosion heat resistant alloy, the NCF600 alloy, the NCF601 alloy, the Inconel®

600 alloy, the Inconel® 601 alloy are more suitably applied to the present invention in view of a processability, a poor nitriding property, a fluoride resistant property, and the like.

In a case where the anti-corrosion heat resistant alloy described above is used for the core internals such as the material of the furnace walls, the anti-corrosion heat resistant alloy is used in a rolled state, so that the surface roughness thereof in Ra is relatively rough (i.e., about 3). The nitriding treatment itself can be executed to the anti-corrosion heat resistant alloy as it is. However, setting the surface roughness to 1.6 μm or less in Ra by means of, e.g., grinding, causes the surface oxide film formed on the surface to have an even thickness to stable the surface. Accordingly, a corrosive effect and the nitriding reaction due to the halogen compound gas, e.g., the hydrogen fluoride gas, can be prevented from being produced and progressed, respectively.

In other words, it is noticeably effective to improve the surface roughness as much as possible by grinding the surface in order to prevent these reactions from being progressed as much as possible or in order to suppress the speed of progress as much as possible. The surface roughness of the surfaces of the core internals is desirably set to 1.6 μm or less in Ra when at least the halogenation treatment and the nitriding treatment are initially performed.

As described above, by decreasing the surface roughness of, for example, the furnace walls to 1.6 μm or less in Ra, the lives of the core internals used in the furnace of heat treatment can be extended. On the other hand, in a case where even the grinding is executed, the surface oxide film on the surfaces of the core internals cannot be completely prevented from being destructed since the surface oxide film is repetitively exposed to fluorine and/or the fluorine compound gas. Therefore, the nitriding cannot be prevented from a gradual progress.

At the time, in a case of an apparatus for performing the halogenation treatment and the nitriding treatment by using the same treatment chamber, the nitriding is accelerated as a temperature according to a condition of the halogenation treatment becomes higher and/or a concentration of the halogen and/or the halogen compound gas becomes higher. Alternatively, in a case where the halogenation treatment and the nitriding treatment are performed within independent treatment chambers, the nitriding is accelerated as an amount of the fluorine compound to be introduced into the nitriding treatment chamber becomes greater. Further, in either case, as a nitriding temperature is higher and a nitriding time is longer, the nitriding is accelerated.

In a case where the nitriding reaction progresses because of the repetitive nitriding treatment, if the thickness of the nitrided layer is 25 μm or less and the surface hardness of the nitrided layer is within a range equal to or less than 900 Hv, the rough surface and minute cracks occur but the nitriding quality of the article to be treated is not largely affected. On the other hand, if the thickness of the nitrided layer becomes greater than 25 μm, the surface hardness also increases beyond 900 Hv and a toughness of the surface portion is dramatically degraded to generate the grain boundary cracks. Therefore, the nitriding quality of the article to be treated is adversely affected.

In other words, when the grain boundary cracks are generated in the surfaces of the core internals, it is so considered that a decomposition rate of, for example, the $NH_3$ gas changes and thus a stable treatment condition cannot be kept. Although the reasons thereof are not clearly known, it is so considered that the above result is invited because a catalytic effect on the surfaces is degraded because the cracks generated in the surfaces of the core internals helps gas adsorption of, for example, the moisture or desorption thereof hardly occurs.

In this embodiment, when the halogenation treatment and the nitriding treatment are repetitively performed, the nitrided layer formed on the surfaces of the core internals is used in a range of the thickness of 25 μm or less and the surface hardness of 900 Hv or less.

Specifically, when the thickness of the nitrided layer exceeds 25 μm, at least a portion of the nitrided layer is removed to be the thickness equal to or less than 25 μm as well as the cracks generated in the surfaces are substantially eliminated. For example, in a case where the nitrided layer having the thickness of more than 25 μm is formed and a lot of cracks are generated in the surfaces, the surface is removed by the grinding or shot blasting and thus the stable nitriding treatment quality is kept.

Removal of the nitrided layer by the surface grinding or the shot blasting causes the nitrided layer to have the thickness of 25 μm or less, preferably, thickness of 15 μm or less. Further, the cracks generated in the surfaces are substantially removed. Preferably, the entire nitrided layer is removed. As a result, the catalytic effect on the surfaces is recovered to the extent that the stable treatment can be executed.

In this case, as the thickness of the nitrided layer formed on the surfaces of the core internals becomes thicker, the hardness of the surface portion becomes harder and therefore, the removal by the grinding or the like is hardly susceptible. In view of the above, the removal by the grinding or the like is preferably executed under a condition that the thickness of the nitrided layer is 20 μm or less and the surface hardness of the nitrided layer is 800 Hv or less.

At least a partial removal of the nitrided layer by the surface grinding or the shot blasting causes the surface roughness after the removal to set to 1.6 μm or less in Ra. Accordingly, it is more preferable, again, because the occurrence and/or the production of the corrosive effect by the fluorine or the fluorine compound gas and the progress of the nitriding reaction can be delayed.

When at least a portion of the nitrided layer is removed by the surface grinding or the shot blasting, in order to determine timing thereof; the thickness of the nitrided layer on the surfaces of the core internals is to be known accurately to execute the removal. Accordingly, a test piece made of the same material as the material of the surfaces of the core internals is placed within the treatment space and, when the halogenation treatment and the nitriding treatment are repetitively performed, the thickness of the nitrided layer formed on the surfaces of the core internals is estimated based on a state of the test piece.

For example, the test piece, made of the same material and having a surface state equivalent to the material used for the core internals, is prepared to be removably in advance attached to the furnace wall or the like for the sake of confirmation of the thickness of the nitrided layer. While the nitriding treatment is repeated, the test piece is removed at a predetermined timing to partially cut the test piece. Then, according to a method of, for example, a microscope observation, the thickness and the surface hardness of the nitrided layer are measured.

As the thickness and the surface hardness of the nitrided layer come closer to limit values, i.e., the thickness comes to 25 μm, preferably 20 μm, and the surface hardness comes to 900 Hv, preferably 800 Hv, respectively, the surfaces of the core internals and the surface of the remaining part of the test piece are subjected to the removal treatment of the nitrided layer by the above described surface grinding and shot blasting. The test piece after removing the nitrided layer therefrom is attached within the furnace. On the other hand, if there still is a room to the limit values, the remaining part of the test piece is attached within the furnace again to repeat the nitriding treatment. According to the above, timing for the grinding can be accurately known before the poor nitriding occurs.

EXAMPLE 1

Now, an example according to the present invention is described below.

FIG. 1 illustrates an example of a cross sectional view of a furnace of heat treatment according to the present invention. In this example, the fluorination treatment and the nitriding treatment are performed within the same treatment space.

The furnace of heat treatment is provided with a heater 2 on an inner surface of a furnace body. An interior space of a furnace wall 3 as the core internals placed inside the heater 2 is a treatment space. A temperature control of the treatment space can be performed by the heater 2. Inside the furnace wall 3 exposed to the treatment space, a test piece 4 made of the same material as a material of the furnace wall 3 and having a surface roughness equivalent to the inner surface of the furnace wall 3 resulted from a surface finishing similar to that performed to the inner surface of the furnace wall 3 is detachably attached in order to confirm a state of the furnace wall.

In FIG. 1, a reference numeral 7 denotes a gas introduction pipe 7 for introducing an atmospheric gas into the treatment space upon the fluorination treatment and the nitriding treatment, a reference numeral 8 denotes a gas exhaustion pipe 8 for exhausting the atmospheric gas from the treatment space, a reference numeral 9 denotes a furnace gas agitation fan 9 for agitating the atmospheric gas within the treatment space, and a reference numeral 10 denotes a motor 10 for the agitation fan for driving the furnace gas agitation fan 9.

In this example, the article to be treated is charged into the treatment space and the temperature of the treatment space is raised to a predetermined fluorinating temperature. Thereafter, the atmospheric gas containing $NF_3$ for fluorination treatment is introduced into the space to keep heating, thereby performing the fluorination treatment. Subsequently, the atmospheric gas for fluorination treatment is exhausted and purged and, thereafter, the temperature of the treatment space is controlled to be changed to a predetermined nitriding temperature. The atmospheric gas containing $NH_3$ for the nitriding treatment is introduced into the space to keep heating, thereby performing the nitriding treatment.

Accordingly, the surface of the test piece 4 is exposed to a gas atmosphere equivalent to that of the inner surface of the furnace wall 3 as well as becomes an equivalent temperature. Therefore, a state of the inner surface of the furnace wall 3 can be known substantially accurately by confirming the surface state of the test piece 4.

In this example, a jig 6 is made of aluminum as a non-nitriding material such that an affect caused by a degradation of the jig can be ignored. In order to confirm the stability of the nitriding treatment over time when the nitriding treatment is repeated, a test piece 5 to be nitrided having a size of 30×30×5 mm made of SUS304 as a test piece for confirming a change of the thickness of the nitrided layer over time is placed.

A material of NCF600 is used as a material for the furnace wall 3 and a material for the test piece 4. Such a furnace of heat treatment is prepared as Example (a) that the inner surface of the furnace wall 3 and the test piece 4 are ground so as to have the surface roughness ranging between 0.8 and 1.5 μm in Ra and, as shown in FIG. 1, the test piece 4 is attached to the inner surface of the furnace wall 3 so as to contact the inner surface of the furnace wall 3.

Such a treat furnace is prepared as Example (b) that the inner surface of the furnace wall 3 and the surface of the test piece 4 have a surface roughness ranging between 2.5 and 3.5 μm in Ra equivalent to a state after a normal hot rolling. As shown in FIG. 1, the test piece 4 is attached to the inner surface of the furnace wall 3 so as to contact the inner surface of the furnace wall 3. Further, a test piece 4 made of NCF601 having the surface roughness ranging between 2.5 and 3.5 μm in Ra is also attached to the inner surface of the furnace wall 3 of Example (b), in a similar manner as described above, as Example (b)'.

A material of NCF800 that is one of the anti-corrosion heat resistant alloys is used as a material for the furnace wall 3 and a material for the test piece 4. Such a treat furnace and a test piece are prepared as Comparative Example (c) that the inner surface of the furnace wall 3 and the test piece 4 are ground so as to have the surface roughness ranging between 0.8 and 1.5 μm in Ra and the test piece 4 is attached to the inner surface of the furnace wall 3.

Main chemical compositions (mass %) of the above described materials of NCF600, NCF601, and NCF800 used in the examples and the comparative example are described in the following Table 1.

TABLE 1

| | Material | C | Si | Mn | Ni | Cr | Fe | Cu | Al | Ti |
|---|---|---|---|---|---|---|---|---|---|---|
| Examples | NCF600 | 0.05 | 0.19 | 0.22 | 74.2 | 15.6 | 9.71 | 0.04 | — | — |
| | NCF601 | 0.03 | 0.12 | 0.28 | 59.7 | 22.7 | 15.6 | 0.21 | 1.35 | — |
| Comparative Example | NCF800 | 0.04 | 0.36 | 0.67 | 33.9 | 21.8 | 42.4 | 0.16 | 0.40 | 0.37 |

By using these treat furnaces, as shown in FIG. 1, a test piece 5 to be nitrided made of SUS304 is disposed within the treat furnace while the test piece 5 is placed on an alumina made jig 6. Then, a temperature of the treat furnace is raised up to 350° C. under an $N_2$ atmosphere, and a $NF_3$ gas of 3 vol % is introduced into the furnace to keep it for 30 minutes. After the temperature of the furnace is raised to 590° C. under the $N_2$ atmosphere, and kept for two hours under an atmosphere of the $NH_3$ gas of 70 vol % and a RX gas of 30 vol %. Subsequently, the nitriding treatment is executed such that the furnace is cooled down to a temperature equal to or less than 100° C. under the $N_2$ gas atmosphere. The RX gas is a converted gas, e.g., a methane gas, a propane gas, or a butane gas. The RX gas is a gas mixture which mainly contains a $N_2$ gas, a $H_2$ gas, and a CO gas.

Figure 2:
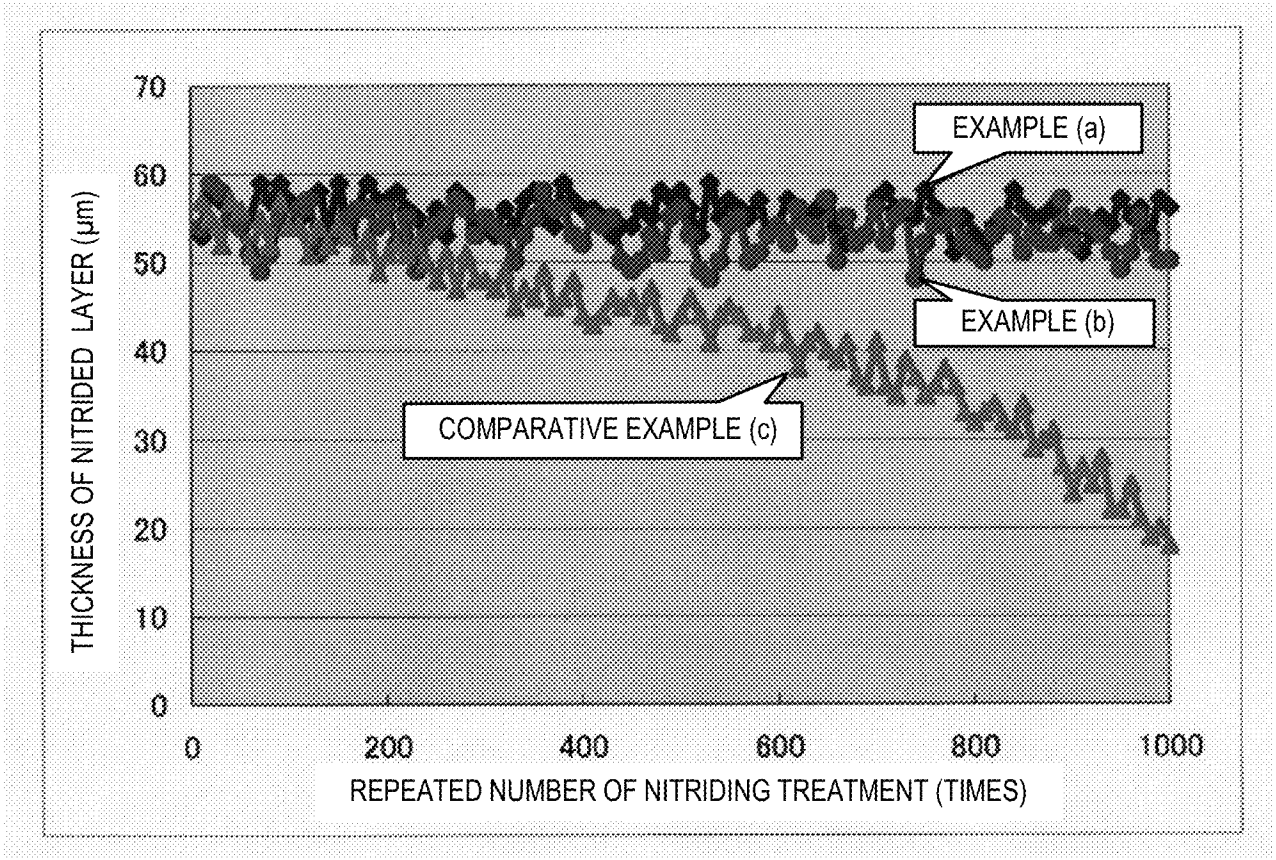
FIG. 2 is a graph illustrating transitions of thicknesses of nitrided layers of test pieces to be nitrided made of SUS304.

The results of measurements of the thickness of the nitrided layer (i.e., the thickness of an average portion) of the test piece 5 to be nitrided made of SUS304 after the above described treatment was repeated for every 10 times in each treat furnace is illustrated in FIG. 2, where the treatment was repeated for 1000 time in total.

In FIG. 2, after the nitriding treatment is executed for 1000 times, the thickness of the nitrided layer of the test piece 5 to be nitrided made of SUS304 changes little in Examples (a) and (b) and thus it is known that the decomposition state of the $NH_3$ gas and the like within the furnace is fine.

Figure 3:
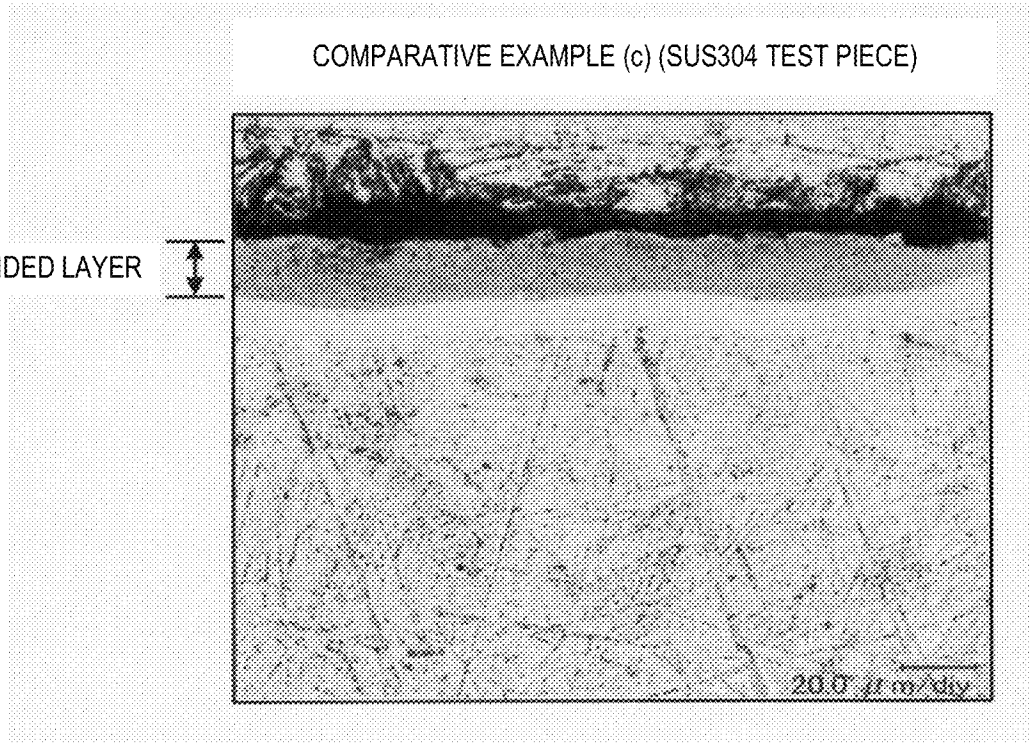
FIG. 3 is a cross-sectional structure of the test piece to be nitrided made of SUS304 of a comparative example.

On the other hand, in Comparative Example (c), although the surface of the furnace wall is ground before the surface is subjected to the treatment, the thickness of the nitrided layer starts to be reduced in an early stage and, at the time of 1000 times execution of the nitriding treatment, the thickness becomes about ⅓ of the original thickness. A cross sectional picture thereof is shown in FIG. 3 where the thickness of the nitrided layer is apparently uneven. This means that the decomposition states of the $NF_3$ gas and the $NH_3$ gas become worse.

Figure 4:
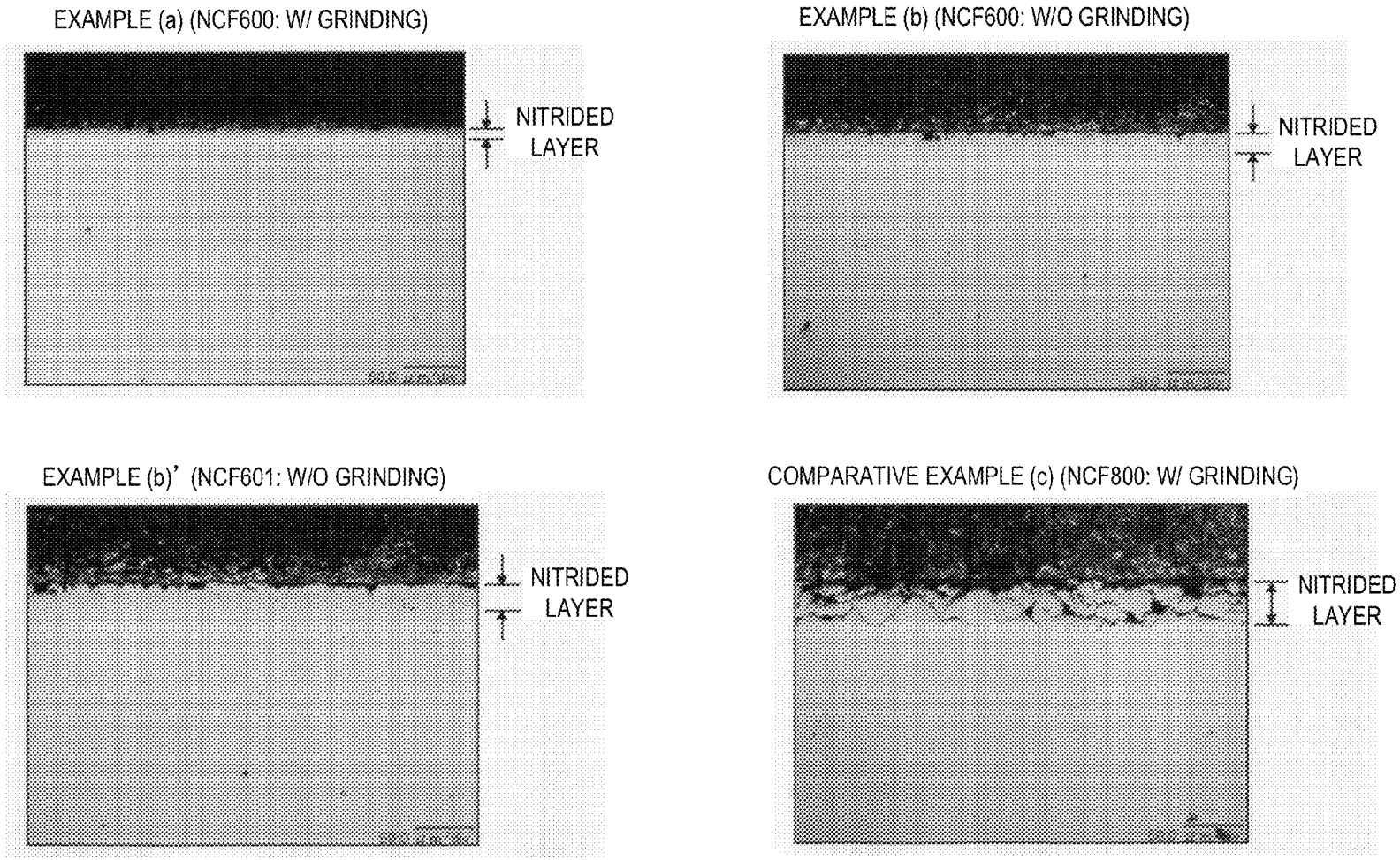
FIG. 4 shows cross-sectional structures of the test pieces of furnace wall materials after nitriding treatments are executed to the test pieces for 1000 times.

In Table 2, the thicknesses of the nitrided layer and the surface hardness of the test piece 4 made of the respective anti-corrosion heat resistance alloys at the time of 1000 times execution of the nitriding treatment are shown. In FIG. 4, cross sectional photographs of the surface portions of the test piece 4 of the respective anti-corrosion heat resistant alloys are shown. In Comparative Example (c), there are many cracks which may be generated due to an embrittlement of the nitrided layer and it is so assumed that the inner surface of the furnace wall 3 has a state similar to the surface portion of the test piece 4. It was so assumed that this phenomenon induces a poor nitriding of Comparative Example (c).

TABLE 2

| | Nitrided Layer Thickness (μm) | Surface Hardness (Hv) |
|---|---|---|
| Example (a) [NCF600: w/ Grinding] | 10 | 433 |
| Example (b) [NCF600: w/o Grinding] | 18 | 701 |
| Example (b)' [NCF601: w/o Grinding] | 24 | 858 |
| Comparative Example (c) [NCF800: w/ Grinding] | 40 | 1044 |

On the other hand, in Examples (b) and (b)', a plurality of cracks are started to be formed in the surface; however, as it is shown in the result of the thickness of the nitrided layer of the test piece made of SUS304 in FIG. 2, even after the 1000 times execution of the nitriding treatment, the stable nitriding treatment can be executed within a range of the original dispersion. As the results of Examples (b) and (b)' of FIG. 4, in a case where the chemical composition of the material of the furnace wall or the like includes Ni ranging between 50 mass % or more and 80 mass % or less and Fe ranging between 0 mass % or more and 20 mass % or less, it is known that, if the thickness of the nitrided layer is up to around 25 μm, no problem would occur in the nitriding treatment performance.

In a case where, as in Example (a), the surface is ground before the treatment is executed and the surface roughness is set to 1.6 μm or less in Ra, it is known that the stable nitriding treatment can be executed as well as only extremely thin nitrided layer is formed and only little cracks occur even after the 1000 times repetition of the nitriding treatment.

Further, as the results of the above, by attaching the test piece 4 for confirming the state of the furnace wall 3 to the inner surface of the furnace wall 3, wherein the test piece 4 is made of the same material as the inner surface of the furnace wall 3 and was subjected to a similar surface finishing as it was done for the inner surface of the furnace wall 3, a state of the inner surface of the furnace wall 3 can be almost accurately known by confirming the surface state of the test piece 4.

EXAMPLE 2

In Example (d), the inner surface of the furnace wall 3 and the surface of the test piece made of the anti-corrosion heat resistant alloy of Example (b) after the 1000 times repetition of the nitriding treatment are ground by using a paper disk grinder to the extent that the cracks in the surfaces are almost completely eliminated and the surface roughness becomes a range between 0.8 and 1.5 μm in Ra. At the time, the thickness of the nitrided layer of the surface of the test piece 4 made of the anti-corrosion heat resistant alloy was about 10 μm. By using this treat furnace, the additional 1000 times fluorination treatment and nitriding treatment were executed under the same condition as Example 1.

In Comparative Example (e), the treat furnace having the inner surface of the furnace wall 3 and the surface of the test piece 4 made of the anti-corrosion heat resistant alloy, similar to those of Example (b), is prepared and the fluorination treatment and the nitriding treatment are executed for 2000 times under the same condition as Example 1.

In both of Example (d) and Comparative Example (e), the test piece 5 to be nitrided made of SUS304 is placed within the furnace in a similar manner to Example 1. At the time, a transition of the results of measurements (after the 1000 times repetition of the nitriding treatment) that the thickness (i.e., the thickness of an average portion) of the nitrided layer of the test piece 5 to be nitrided made of SUS304 in each treat furnace is measured every 10 times.

Figure 5:
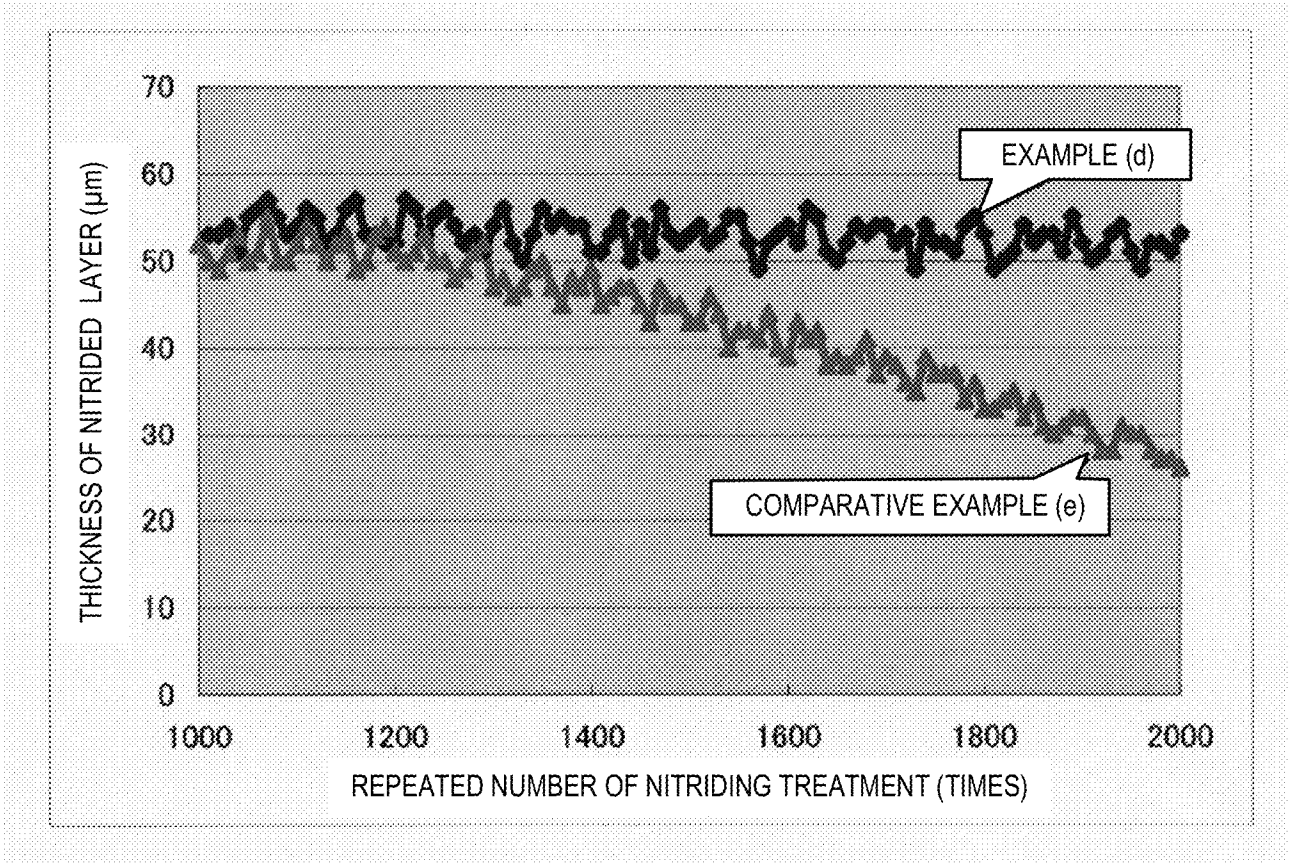
FIG. 5 is a graph illustrating transitions of the thicknesses of nitrided layers of test pieces to be nitrided made of SUS304.

In view of the result of FIG. 5, in Comparative Example (e), the nitrided layer comes to be thinner at a point at which the number of the repetition of the nitriding treatment goes beyond 1300 times and the nitrided layer becomes thinner to about ½ of the original thickness at a point at which the nitriding treatment is completed for 2000 times.

Contrary to the above, in Example (d) in which the grinding is performed after the repetition of the nitriding treatment for 1000 times, even in a case where the additional 1000 times nitriding treatment is executed, the stable nitriding treatment can still be executed within a range of the original dispersion.

Figure 6:
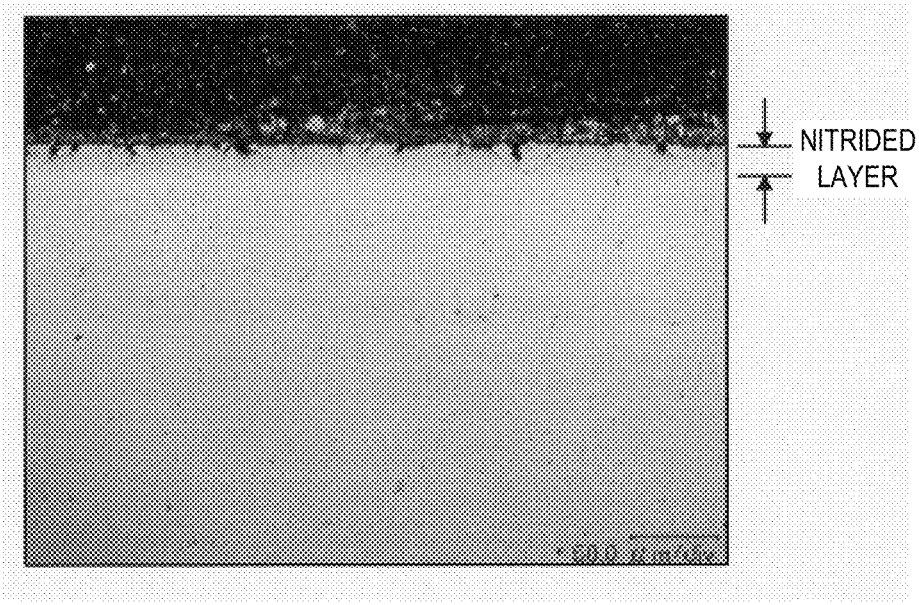
FIG. 6 is cross-sectional structures of the test pieces for the furnace wall materials after the nitriding treatments are executed to the test pieces for 2000 times.
Figure 6:
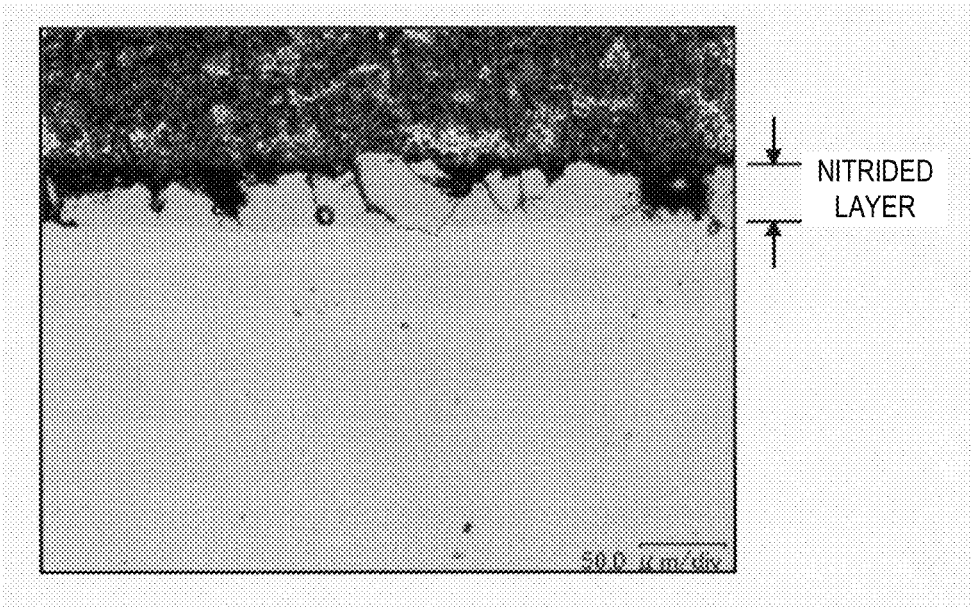

In FIG. 6, a cross sectional photograph of the surface portion of the test piece 4 made of the anti-corrosion heat resistant alloy when the test piece 4 is placed on the furnace wall 3 so as to contact the furnace wall 3 after the 2000 times repetition of the nitriding treatment is shown. In Comparative Example (e), the nitrided layer has the thickness of about 34 μm and includes a lot of cracks. To the contrary, in Example (d), the nitrided layer has the thickness of 16 μm and includes shallow cracks in the surface of the nitrided layer. It is so considered that the above described difference contributes to a difference in the thickness of the nitrided layer of the test piece 5 to be nitride made of SUS304 of FIG. 5.

In Example (d), the thickness of the nitrided layer after the 1000 times repetition of the nitriding treatment followed by the grinding was about 10 μm, whereas the thickness of the nitrided layer after additional 1000 times nitriding treatment was about 16 μm, i.e., an increase amount of the thickness of the nitrided layer was relatively small. In view of the above, an effect of the execution of the surface grinding, in which the nitrided layer was ground to have the surface roughness of 1.6 μm or less in Ra, is produced. Therefore, by grinding the nitrided layer so as to have the surface roughness of 1.6 μm or less in Ra not only before the use but also after formation of the nitrided layer, stable treatment can be executed for a longer period of time.

As the nitrided layer comes to be thicker, the hardness of the nitrided layer becomes higher and the thickness of the portion having the higher hardness becomes thicker, so that removal of the nitrided layer by the grinding can hardly be achieved. Therefore, it is preferable that the grinding is executed while the nitrided layer has the thickness equal to or less than 20 μm and, at the time, it is more preferable to, as a matter of course, remove the entire nitrided layer and to grind the nitrided layer so as to have the surface roughness of 1.6 μm or less in Ra.

In view of the above descried results, anti-corrosion heat resistant alloy having a chemical composition of Ni ranging between 50 mass % or more and 80 mass % or less and Fe ranging between 0 mass % or more and 20 mass % or less is used at least as the surface material of the furnace wall of the nitriding furnace, thereby enabling the execution of the stable treatment for a long period of time. Further, smaller surface roughness thereof achieves the nitriding furnace that can be stably used for a long period of time. In Examples 1 and 2, the stability of the nitriding furnace is confirmed by the test piece made of SUS304. However, in a case where any other various types of steels are also subjected to the nitriding treatment, the nitriding furnace having the above configuration can be used stably for a long period of time.

INDUSTRIAL APPLICABILITY

By using the furnace of heat treatment for performing the nitriding treatment for the steel material according to the present invention, in a case where, for example, the treatment is performed to the steel type which is hard to be nitrided and a treated product having strict management values, since the stable fluorination treatment and nitriding treatment can be executed for a long period of time, the present invention can be suitably used in the nitriding treatment of the various treated products including mechanical parts and dies.

DESCRIPTION OF REFERENCE NUMERALS

1 furnace body
2 heater
3 furnace wall
4 test piece
5 test piece to be nitrided
6 jig
7 gas introduction pipe
8 gas exhaustion pipe
9 furnace gas agitation fan
10 motor for agitation fan

What is claimed is:

1. A method of heat treatment for performing a halogenation treatment and a nitriding treatment by heating a steel material to be subjected to halogenation treatment and nitriding treatment under a predetermined atmosphere, comprising:

using an alloy containing Ni ranging between 50 mass % or more and 80 mass % or less and Fe ranging between 0 mass % or more and 20 mass % or less as a material of a surface of a core internal exposed to a treatment space where at least the nitriding treatment is performed; and removing at least a portion of a nitrided layer, after the halogenation treatment and the nitriding treatment are repeated, which result in the nitrided layer formed on the surface of the core internal having a thickness greater than 25 μm, so that a thickness of the nitrided layer becomes 25 μm or less.

2. A method of using a heat treatment furnace for performing a halogenation treatment and a nitriding treatment by heating a steel material to be subjected to halogenation treatment and nitriding treatment under a predetermined atmosphere, comprising:

using an alloy containing Ni ranging between 50 mass % or more and 80 mass % or less and Fe ranging between 0 mass % or more and 20 mass % or less as a material of a surface of a core internal exposed to a treatment space defined by the heat treatment furnace where the nitriding treatment is performed; and removing at least a portion of a nitrided layer, after the halogenation treatment and the nitriding treatment are repeated, which results in the nitrided layer formed on the surface of the core internal having a thickness greater than 25 μm, so that a thickness of the nitrided layer becomes 25 μm or less.

3. The method of using a heat treatment furnace according to claim 2, wherein at least a portion of the nitrided layer or all of the nitrided layer is removed so that a surface roughness of the surface of the core internal becomes 1.6 μm or less in Ra.

4. The method of using a heat treatment furnace according to claim 3, wherein at least a portion of the nitride layer or all of the nitride layer is removed and cracks generated in the surface are substantially eliminated.

5. The method of using a heat treatment furnace according to claim 4, wherein a test piece made of the same material as and having a similar surface roughness to the material of the surface of the core internal is placed within the treatment space, and when the halogenation treatment and the nitriding treatment are repeated, a thickness of the nitrided layer formed on the surface of the core internal is estimated based on a state of the test piece.

6. The method of using a heat treatment furnace according to claim 3, wherein a test piece made of the same material as and having a similar surface roughness to the material of the surface of the core internal is placed within the treatment space, and when the halogenation treatment and the nitriding treatment are repeated, a thickness of the nitrided layer formed on the surface of the core internal is estimated based on a state of the test piece.

7. The method of using a heat treatment furnace according to claim 3, wherein at least a portion of the nitrided layer is removed so that a surface hardness becomes 900 Hv or less.

8. The method of using a heat treatment furnace according to claim 2, wherein at least a portion of the nitrided layer or all of the nitrided layer is removed and cracks generated in the surface are substantially eliminated.

9. The method of using a heat treatment furnace according to claim 8, wherein a test piece made of the same material as and having a similar surface roughness to the material of the surface of the core internal is placed within the treatment space, and when the halogenation treatment and the nitriding treatment are repeated, a thickness of the nitrided layer formed on the surface of the core internal is estimated based on a state of the test piece.

10. The method of using a heat treatment furnace according to claim 8, wherein at least a portion of the nitrided layer is removed so that a surface hardness becomes 900 Hv or less.

11. The method of using a heat treatment furnace according to claim 2, wherein a test piece made of the same material as and having a similar surface roughness to the material of the surface of the core internal is placed within the treatment space, and when the halogenation treatment and the nitriding treatment are repeated, a thickness of the nitrided layer formed on the surface of the core internal is estimated based on a state of the test piece.

12. The method of using a heat treatment furnace according to claim 11, wherein at least a portion of the nitrided layer is removed so that a surface hardness becomes 900 Hv or less.

13. The method of using a heat treatment furnace according to claim 2, wherein at least a portion of the nitrided layer is removed so that a surface hardness becomes 900 Hv or less.

* * * * *